US005337655A

United States Patent [19]

Bielfeldt

[11] Patent Number: 5,337,655

[45] Date of Patent: Aug. 16, 1994

[54] CONTINUOUSLY WORKING PRESS HAVING ENTRY SYSTEMS FOR APPLYING A VARIABLE PRESSURE PRIOR TO A MATERIAL BEING PRESSED

[75] Inventor: Friedrich B. Bielfeldt, Eppingen, Fed. Rep. of Germany

[73] Assignee: Maschinenfabrik J. Dieffenbacher GmbH & Co., Eppingen, Fed. Rep. of Germany

[21] Appl. No.: 40,076

[22] Filed: Mar. 30, 1993

Related U.S. Application Data

[63] Continuation of Ser. No. 775,420, Oct. 15, 1991, abandoned.

[30] Foreign Application Priority Data

Oct. 15, 1990 [DE] Fed. Rep. of Germany ..... 4032700

[51] Int. Cl.[5] ..... B30B 15/34; B30B 5/04

[52] U.S. Cl. ..... 100/93 P; 100/154; 425/371; 156/555; 156/583.5

[58] Field of Search ..... 100/35, 38, 41, 93 P, 100/93 RP, 151-154; 425/371; 264/280; 156/555, 583.5

[56] References Cited

U.S. PATENT DOCUMENTS

| | | | |
|---|---|---|---|
| 3,111,149 | 11/1963 | Schubert | 100/154 X |
| 3,680,476 | 8/1972 | Pfeiffer | 100/151 |
| 3,929,065 | 12/1975 | Csordas et al. | 100/154 X |
| 3,945,789 | 3/1976 | Boman | 425/371 |
| 3,981,666 | 9/1976 | Wadman | 425/371 |
| 4,336,096 | 6/1982 | Dedekind | 100/154 X |
| 4,517,148 | 5/1985 | Churchland | 100/154 X |
| 4,613,293 | 9/1986 | Gerhardt | 424/371 |
| 4,647,417 | 3/1987 | Böttger et al. | 100/154 X |
| 4,718,843 | 1/1988 | Carlsson et al. | 100/154 X |
| 4,850,846 | 7/1989 | Walter | 100/152 X |
| 4,923,384 | 5/1990 | Gerhardt | 100/154 X |
| 5,112,209 | 5/1992 | Ahrweiler et al. | 425/371 |

FOREIGN PATENT DOCUMENTS

| | | | |
|---|---|---|---|
| 2052159 | 4/1972 | Fed. Rep. of Germany | 425/371 |
| 2222419 | 11/1972 | Fed. Rep. of Germany | 100/151 |
| 2205575 | 8/1973 | Fed. Rep. of Germany | 425/371 |
| 3133792 | 3/1983 | Fed. Rep. of Germany | 425/371 |

*Primary Examiner*—Stephen F. Gerrity
*Attorney, Agent, or Firm*—Foley & Lardner

[57] ABSTRACT

A continuously working press is disclosed which includes first and second flexible, endless steel belts which are guided around a press table and a press ram via drive drums and return drums and which are supported on a plurality of roller bars. Each of two entry systems has an entry area which extends from an entry tangent to a starting point of a high pressure area and which is divided into a roller bar orientation area, a curved precompression area for the material to be pressed, and a straight compression area. The last third of the roller bar orientation area and all of the precompression area of each of the entry systems have a radius of curvature $R_E$ which is between one and two times radius of curvature of the return drums $R_U$. A plurality of computer-controlled hydraulic supporting members support the first and second entry systems and apply a pressure to the material to be pressed. The applied pressure increases constantly from 0 bar at the entry tangent up to a maximum pressure $HP_{max}$ at the high pressure area. The hydraulic supporting members provide a servo-hydraulically adjustable force profile having a variable compression angle, with the applied pressure increasing constantly from 0 to $HP_{max}/4$ from the start of the roller bar orientation area up to the end of the first one quarter of the precompression area.

2 Claims, 4 Drawing Sheets

CONTINUOUSLY WORKING PRESS HAVING ENTRY SYSTEMS FOR APPLYING A VARIABLE PRESSURE PRIOR TO A MATERIAL BEING PRESSED

This application is a continuation, of application Ser. No. 07/775,420, filed Oct. 15, 1991, now abandoned.

BACKGROUND OF THE INVENTION

1. Field of the Invention

The invention relates to a continuously working press which includes a press ram, a press table spaced apart from the press ram with an adjustable press gap being formed therebetween, drive drums and return drums, and first and second flexible, endless steel belts which are guided around the press table and the press ram via the drive drums and the return drums.

2. Discussion of the Related Art

It has been technologically proved that the best physical data, such as transverse tensile strength and bending strength for substances such as chipboards, are obtained when rapid pressure build-up occurs upon contact with the material to be pressed. That is, with the start of pressing, this material to be pressed is immediately compressed at a very high pressure up to the maximum applied pressure. This provides a very uniform and rapid heat transfer from outside to inside within the chip structure. Furthermore, in the course of the effective heat transfer under immediate action of pressure, preliminary hardening of the cover layer is no longer possible. Since preliminary hardening requires more sanding of material, these favorable technological conditions also provide the best economic preconditions by requiring less sanding of material. These requirements are intended to be met by providing continuously working presses which, in their entry area comprising the area following the entry gap predetermined by the return drums for the press belts, can set a pressure variation curve which can be adapted to the particular press tasks and operating conditions. The entry gap is normally set in a stationary position in a wedge shape with a cross-section decreasing in the entry direction, the intention being able to adjust the device to exert more or less pressure over its length on the material to be pressed as the material enters the press. In the press according to German Offenlegungsschrift 2,205,575, which is provided with a rolling-bearing chain, pressure pieces are arranged in the press gap between the rolling-bearing entrance and the return drums for the press belts. In the relevant area, these pressure pieces exert a selectively adjustable pressure on the material to be pressed. As a result, these pressure pieces set the entry gap more or less wide. In this embodiment, the steel belt is merely returned in the front area. This is then followed by a virtually pressureless sliding section and only then by the actual rolling-bearing entrance, where the pressure is gradually raised from 0 up to the maximum applied pressure.

Of disadvantage here is the fact that, after the first contact of the material to be pressed under pressure action by the return drums and the pressure bodies, the pressure is relieved twice, so that there is the risk of the initially hardened and embrittled cover layer being damaged by transverse cracks due to the slightest expansion (breathing) of the chip mat and thus of the overall strength of the finished chipboard being reduced.

The fact that the roller bars, although inserted orthogonally in the entry area, lose their predetermined synchronous running with identical spacing between one another in the compression build-up area due to defective chip fillings, given as an example in chipboard manufacture, can be cited as a further disadvantage. This can lead to individual roller bars running up against one another and thus to their destruction.

OBJECTS AND SUMMARY OF THE INVENTION

The object of the invention is to provide a continuously working press which can exert a variable pressure profile for various thicknesses of material to be pressed to changing compression angles. This pressure profile can be varied by varying pressures imposed on entry systems in the entry area. Another object is to provide a press with which, in the case of chip fillings varying in thickness and nature, an equally good surface quality and equally good physical properties can be produced for the finished product.

In accordance with a first aspect of the invention, a continuously working press for manufacturing pressed materials is provided which includes a press ram, a press table spaced apart from the press ram with an adjustable press gap being formed therebetween, and drive drums and return drums. First and second flexible, endless steel belts are guided around the press table and the press ram via the drive drums and the return drums. The first and second belts transmit an applied pressure to a material to be pressed and pull the material to be pressed through the press. A plurality of roller bars are supported on the press table and the press ram and guide the first and second belts through the press. Also provided are a transfer plate which transfers the material to be pressed into the press from a transfer area, and a feed belt which is located in the transfer area and which has a transfer nose, the transfer nose delivering the material to be pressed onto the transfer plate. First and second heating plates are pivotally mounted on the press table and the press ram, respectively, and first and second entry systems are provided on the first and second heating plates and face each other to form an entry gap therebetween adjacent the press gap. Each of the entry systems has an entry area which extends from an entry tangent to a starting point of a high pressure area formed by the press gap and which is divided into a roller bar orientation area, a curved precompression area for the material to be pressed, and a straight compression area. The last third of the roller bar orientation area and all of the precompression area of each of the entry systems have a radius of curvature $R_E$ which is between the same radius and twice the radius of curvature of the return drums $R_U$. Adjusting devices are mounted on the press table and the press ram and adjust the entry gap. In addition, a plurality of computer-controlled hydraulic supporting members are provided which support the first and second heating plates and which apply a pressure through the entry systems and the belts to the material to be pressed, which pressure increases constantly from 0 bar at the entry tangent up to a maximum pressure $HP_{max}$ at the high pressure area. The supporting members increase the pressure through the roller bar orientation area in a frictional and flexible manner and through the precompression area and the compression area so as to split the support into two rigid, divided areas. The hydraulic supporting members also provide a servo-hydraulically adjustable force profile having a variable compression angle and apply a pressure which constantly increases from 0 to $HP_{max}/4$ from the start of the roller bar orientation area up to the end of the first one quarter of the precompression area.

Here, the feeding system according to the invention advantageously enables the correct compression angle and the associated pressure profile to be introduced in a controlled manner at both the top and the bottom for a varying spread in the cover layers and different particle fillings, i.e. different filling density, chip structure and glue content, so that the maximum applied pressure is always achieved at both the end of the entry area and at the start of the high-pressure area. Furthermore, by providing a compression angle which is as small as possible, a high applied pressure can be achieved as quickly as possible, and in fact at least 25% of the maximum applied pressure can be applied during contact of the material to be pressed at an initial contact point PK.

Furthermore, it is advantageous that the roller bars, during the feeding in the roller-bar orientation area "c" and in the first part (a/4) of the precompression area "a" for the material to be pressed, are not subjected to any adverse effects due to the material to be pressed and can thus roll absolutely orthogonally and with the correct spacing until they are clamped fast with about 12 bar (25% of $HP_{max}$).

During the intended contact of the material to be pressed, after passing through the roller-bar orientation section "c" and 25% of the precompression section "a" for the material to be pressed, the material to be pressed can no longer cause any displacement of the roller bars. This is because the roller bars in the curved pre-compression area "a" for the material to be pressed, after leaving the roller-bar orientation area "c", are specifically clamped fast between the steel belt and the curved heating-plate area with a relatively high pressure by means of hydraulic supporting members.

By means of changing the compression angle $\alpha$ at the top and bottom from 0° to 3° (maximum 4°), the point of the entry tangent of the roller-bar feeding sprocket between the radius of curvature $R_E$ of the precompression area "a" of the material to be pressed and the radius of curvature $R_U$ of the return drums also changes in the region of the angle $\beta$. Thus, different compression angles in the compression area "b" result in different entry-tangent angles $\beta$ for the steel belt in the roller-bar orientation area "c". On account of the flexible support of the roller-bar feeding sprockets, there is always frictional support of 0 to about 2 to 4 bar in this area up to the end of the roller-bar orientation area "c". Since the roller-bar orientation devices are likewise arranged on these flexible supports, these roller-bar orientation devices follow the respective spring travel and thus additionally ensure frictional spacing of the roller bars in this area "c".

In accordance with the above explanations, the compression angle $\alpha$ at both the top and bottom is independent of the chipboard thickness and is determined by the chip, particle and fiber structure such a filling density, and thus relative density, or kinematic toughness of the finished board.

Furthermore, it is advantageous that the contact point of the material to be pressed can be located in the curved entry section "a" at a high compression pressure. It is also advantageous that, even after leaving the entry tangent and entering the compression area "b", the material to be pressed is compressed with a constantly increasing pressure up to the maximum pressure.

In this arrangement, the clamping pressure in the curved precompression area "a" for the material to be pressed is in static equilibrium with the produced hydraulic force of the servo-elements and the tensile forces in the steel belts, which are likewise hydraulically supported on the return drums.

The compression of the material to be pressed in the curved precompression area "a" for the material to be pressed also has technological and economic advantages, in particular in the case of the production of thin boards of about 2 to 10 mm. In specific applications, the compression area "b" is swung in at an angle $\alpha=0$ =horizontal with the entry heating plate relative to the entire press area. If the (top and bottom) entry heating plates of the compression area "b" are swung in at a compression angle $\alpha=0$, the material to be pressed already has to be compressed in the curved precompression section "a" for the material to be pressed. The position in accordance with angle $\alpha=0$ is therefore suitable for two technological applications:

I Always for thin boards, e.g. 10 mm chipboard thickness down to a minimum of about 2.0 mm; and II In the case of thick chipboards, e.g. 40 mm, having an extremely low bulk weight of about 500 kg/cbm.

Furthermore, there is an economic advantage in starting with the compression of the material to be pressed according to the technological boundary conditions I and II in the curved precompression section "a" for the material to be pressed, since a press-section length larger than the compression area "b" is provided. Furthermore, the solution according to the invention, depending on the processing requirements, e.g. if there is a varying spread in the cover layers, enables different angular positions to be introduced in a controlled manner on both the top and the bottom. Thus, for example, the bottom entry heating plate can be adjusted horizontally and the top entry heating plate can be adjusted in the angular position such as 0° to 4° for compressing the entire material to be pressed.

The transfer nose of the feed belt cannot be adjusted with respect to different heights of material to be pressed or different chipboard thicknesses but is arranged in a fixed position in front of the entry system. This fixed position is assumed during the continuous working operation. A pivotable transfer plate is installed in front of the transfer nose so that any adjustment of the bottom entry system can be followed.

In order to ensure operationally reliable transfer of the material to be pressed, the initial point of contact of the material to be pressed on the bottom belt is advanced sufficiently far relative to the top contact point of the material to be pressed in the opposite direction to the transport direction by a safety distance "X". This safety distance "X" should be provided approximately in the range of 1 to 5 times the maximum chipboard thickness for which the installation is designed. If the safety distance is too small, there is a risk of the chip mat clamping the transfer plate at the tip of the transfer plate, tearing it off and carrying it into the press area. Consequently, the entire press could be destroyed.

In accordance with another aspect of the invention, a spring plate is provided which is located in the roller bar orientation area of one of the entry systems and which exerts an elastic clamping pressure on the roller bars which increases from 0 to 3 bar as the roller bars travel through the roller bar orientation area. An elastic pressure-keeping plate covers the entry area of the one entry system and the rotational axis of one of the heating plates. The pressure-keeping plate is located between the spring plate and the roller bars.

In accordance with yet another aspect of the invention, the transfer nose is always stationary and deposits the material to be pressed onto the second belt at a point located one quarter of the distance through the precompression area provided that contact between the nose and the second belt is made at a point which is spaced apart from the point at which the material to be pressed contacts the first belt by a safety distance "X" so that, when at least one of the compression angles and the thickness of the material is changed, only a tip of the transfer plate follows the second belt.

Another object of the invention is to provide a method for manufacturing pressed materials.

In accordance with one aspect of the invention, the method includes guiding first and second flexible, endless steel belts around a press table and a press ram via drive drums and return drums and via a plurality of roller bars which are supported on the press table and the press ram, while delivering a material to be pressed to an entry area via a feed belt which has a transfer nose. Other steps include delivering the material to be pressed onto a transfer plate located in a transfer area via the transfer nose of a feed belt, and transferring the material to be pressed onto the second belt in an entry gap of the press from the transfer plate, the entry gap being located adjacent a press gap formed between the press table and the press ram and being formed between first and second entry systems provided on first and second heating plates and facing each other to form the entry gap therebetween. The first and second heating plates employed in this method are pivotally mounted on the press table and the press ram, respectively, and each of the entry systems has an entry area which extends from an entry tangent to a starting point of a high pressure area formed by the press gap and which is divided into a roller bar orientation area, a curved precompression area for the material to be pressed, and a straight compression area. The last third of the roller bar orientation area and all of the precompression area of each of the entry systems have a radius of curvature $R_E$ which is between the same radius and twice the radius of curvature of the return drums $R_U$. Other steps include adjusting the entry gap by activating adjusting devices which are mounted on the press table and the press ram, and applying a pressure through the entry systems and the belts to the material to be pressed via a plurality of computer-controlled hydraulic supporting members which support the first and second heating plates, which pressure increases constantly from 0 bar at the entry tangent up to a maximum pressure $HP_{max}$ at the high pressure area. The pressure is applied in the form of a servo-hydraulically adjustable force profile having a variable compression angle, and increases constantly from 0 to $HP_{max}/4$ from the start of the roller bar orientation area up to the end of the first one quarter of the precompression area.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENTS

Figure 1:
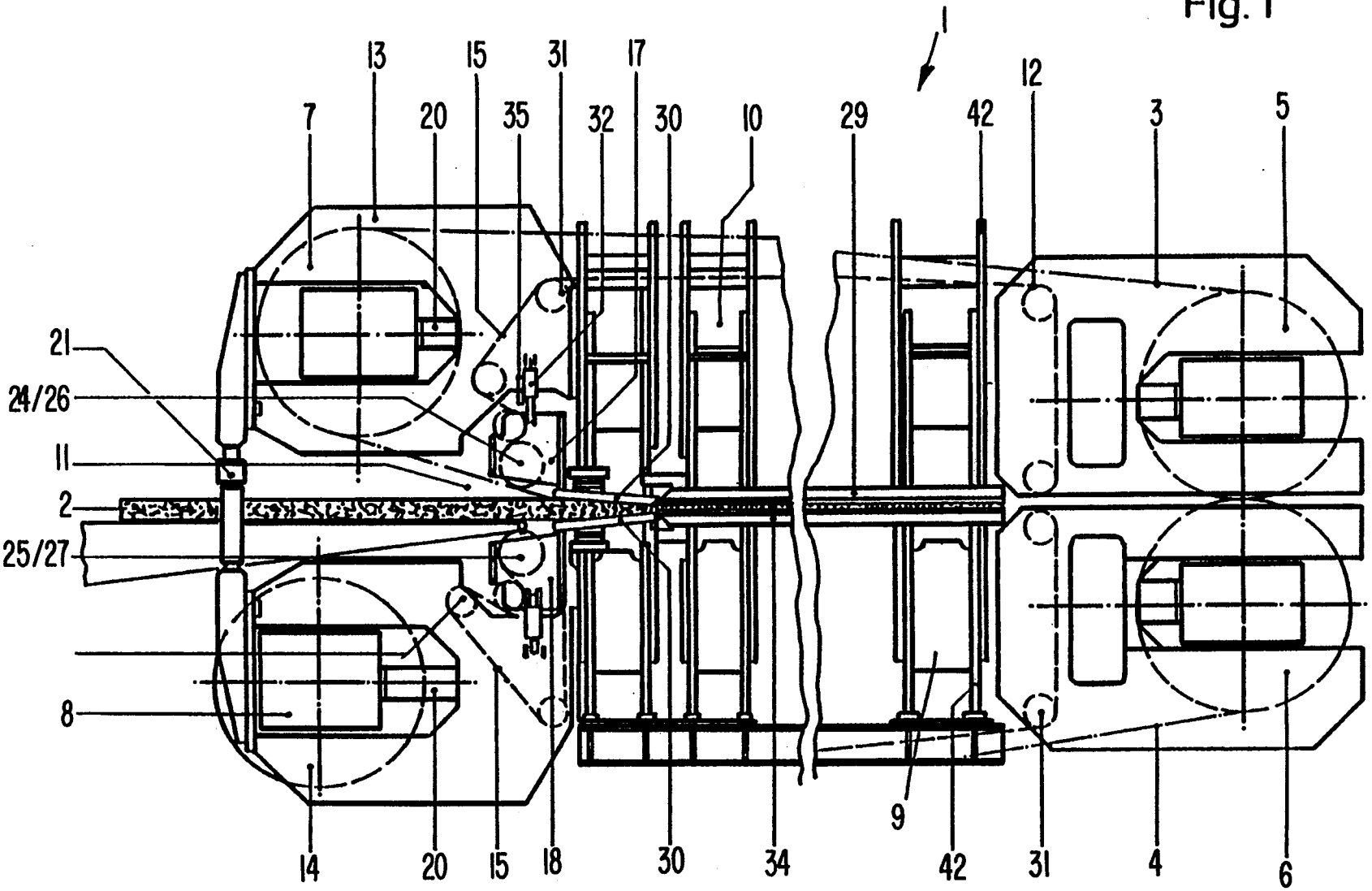
FIG. 1 shows a schematic representation of the press according to the invention in side view.

According to FIG. 1, the continuously working press 1 consists of a press table 9, a movable press ram 10 and tie columns 42 connecting the table 9 to the ram 10. To set the press gap, the press ram 10 is moved up and down by hydraulic piston-cylinder arrangements (not shown) and then locked in the position selected. Steel belts 3 and 4 are guided around the press table 9 and the press ram 10 via respective drive drums 5 and 6 and return drums 7 and 8. To reduce the friction between heating plates 29 and 34, one roller-bar carpet is attached to each of the press table 9 and the press ram 10, and the rotating steel belts 3 and 4. Each roller-bar carpet is formed from roller bars 12 and is likewise provided in a rotating manner. In this arrangement, the roller bars 12, the axes of which extend transversely to the running direction of the belt, are joined together at both longitudinal sides of the press 1 in plate link chains 15 with predetermined pitch and are guided in a rolling manner through the press 1 at heating plates 29 and 34 of press ram 10 and press table 9 on the one hand and at the steel belts 3 and 4 on the other hand in such a way as to carry the material 2 to be pressed with them as a result.

It is further apparent from FIGS. 1 to 4 that the roller bars 12 are fed in a positive-locking and frictional manner into the horizontal press plane by feeding sprockets 24 and 25, and the plate link chains 15 are fed in a positive-locking and frictional manner into the horizontal press plane by two entry sprockets 26 and 27 arranged at the side of the entry heating plate 30. In this arrangement, the feeding sprockets 24 at the press ram 10 and 25 at the press table 9 as well as the entry sprockets 26 at the press ram 10 and 27 at the press table 9 are in each case fastened to one spindle. Reference numeral 33 represents the entry tangent of the feeding sprockets 24 and 25 and thus the start of the establishment of contact between the roller bars 12 and the steel belts 3 and 4. The roller-bar rotation in the press table 9 and press ram 10 is made evident by the return rollers 31. In the roller-bar orientation area "c", the roller bars 12 are changed to the correct rolling position for accurate orientation with identical spacing by periodic actions of pilger-type stepping mechanisms 23 having toothed racks or teeth.

Figure 2:
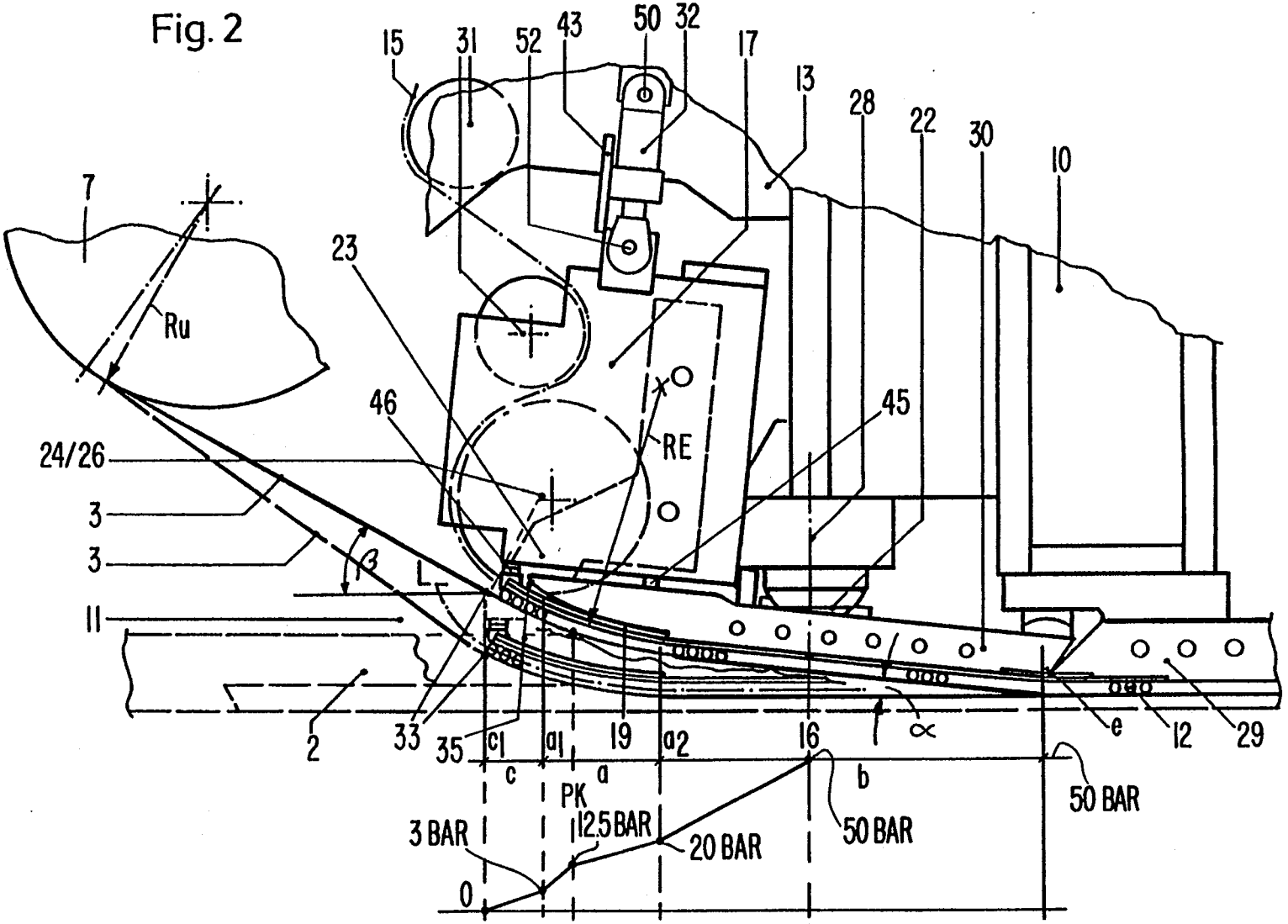
FIG. 2 shows the top entry system for the roller bars in a detail from FIG. 1.
Figure 3:
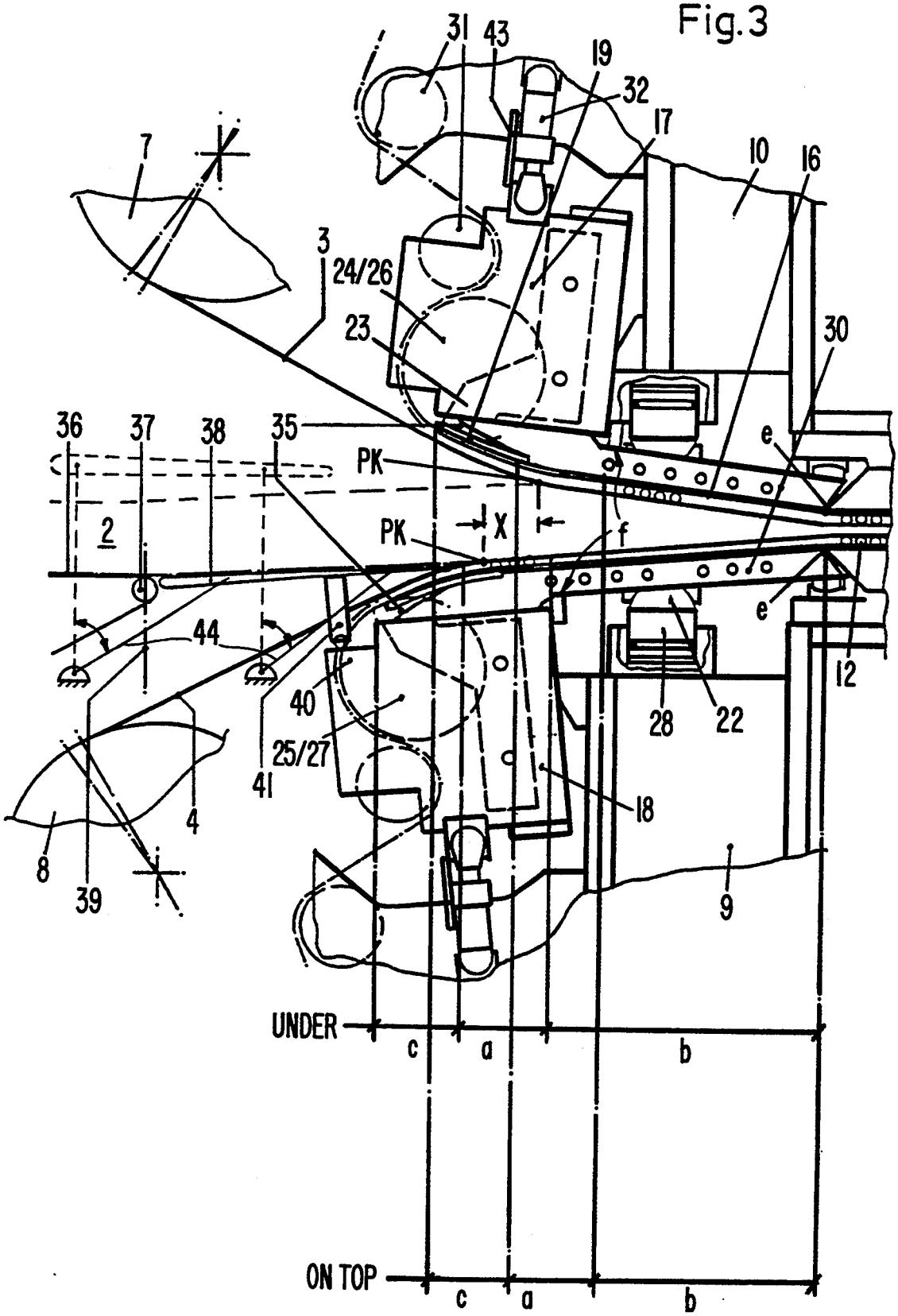
FIG. 3 shows the entry gap of the press according to FIG. 1 on a larger scale with the entry systems for the roller bars of press table and press ram.

According to FIGS. 2 and 3, the material 2 to be pressed is fed with the feed belt 36 into the entry gap 11 and deposited by the transfer plate 38 onto the bottom steel belt 4 at a location PK comprising the point of initial contact with the material to be pressed. An advantageous design of the entry systems 17 and 18 having the pivotable entry heating plates 30 consists in the division of the entry section for the roller bars 12 from the entry tangent point 33 up to the rotational axis "e" into three important subsections, and in fact into the roller-bar orientation area "c", the precompression area "a" for the material to be pressed and the compression area "b". The roller-bar orientation area "c" has, in particular, the function of ensuring a hydraulically controlled, orthogonal feeding of the roller bars 12 into the press area. For this purpose, the entry section from entry tangent point 33 ($=c_1$) up to two-thirds of "c" is of a straight design and from here of a slightly curved design, preferably with a radius equal to the that of the return drum $R_U$ or greater, so that it is always ensured that in every angular position between angle $\alpha=0$ to $\alpha=$about 4° the steel belts are always pressed against the feeding section "c". That is, the roller bars 12 are clamped fast in this sectional stage between the steel belts and the entry heating plates 30. The clamping forces are hydraulically controlled by applying a contact pressure to the roller bars via the steel belts 3 and 4 in the range of about 1 to 3 bar. It is thus ensured that the roller bars are guided in a positive-locking manner at a uniform spacing by means of the roller-bar orientation device 23. At the entry point "$c_1$", the roller bars 12 are deposited onto the steel belts 3 and 4 via the feeding sprockets 24 and 25. At the same time, they are also received in this position by the roller-bar orientation devices 23. The roller-bar orientation section up to $\frac{2}{3}$ of "c" is preferably of a straight design, since the stepping mechanisms 23 act in this area. Section "c" is given elastic, flexible support by a spring plate 19 which is fastened at "$a_2$" and can vibrate in the area of a bevel of the entry heating plate 30 in a free-vibrating wedge 35. Frictionless running of the roller bars 12 in the entry area "c" "a" and "b" is ensured by an elastic pressure-keeping plate 16 which covers this area and merges into the heating plates 29 and 34 respectively through a serrated connection only after the rotational axis "e".

The center area "a" functioning as a precompression section for the material to be pressed, has the function of building up the applied pressure further. This center area, together with the last third of "c" is designed with a radius of curvature $R_E=1$ to 2 times the drum radius $R_U$. The entry systems 17 and 18 are hydraulically pressed in the area of this section against the steel belts 3 and 4, with the roller bars 12 being clamped fast between the steel belts and the pivotable heating plate 30. The hydraulic adjusting forces are produced via short-stroke cylinders 28 and 32; i.e., in the area from the section $\frac{2}{3}$ of "c" and curved section "$a_1$" to "$a_2$", the technologically required compression pressure up to the exit point "$a_2$" is specifically introduced in a hydraulically controllable manner via a computer system from about 3 bar (point "$a_1$") up to about 20 bar. The hydraulic forces in the curved area "a", which act virtually perpendicularly to the steel belts, are in equilibrium with the tensile forces in the steel belts, which are in turn produced by the hydraulic tensioning cylinders 20 at the return drums 7 and 8. To compensate for the respective sloping position, the hydraulic cylinders 28 are provided with appropriate ball cups 22. Arranged along with each of the hydraulic pressure cylinders 28 are hydraulic supporting cylinders 32 which are attached on the outside and are at the same time provided with a displacement-measuring system 43 so that the angular position can thus be checked via the respective displacement position via a central computer (not shown). The hydraulic supporting cylinders 28 and 32 are arranged over the width of the press for uniform pressure distribution. The contact point PK of the material to be pressed starts in the front quarter of the precompression area "a" for the material to be pressed. This ensures that the material 2 to be pressed is immediately compressed with a pressure of P=about 12.5 bar upon contact with the top steel belt 3. By applying a pressure on this contact point PK of the material to be pressed at 12.5 bar, it is ensured that non-uniform chip filling can no longer have any adverse effect on the synchronous running of the roller bars 12.

The compression area "b" has the task of enabling compression of the material 2 to be pressed at various angular positions $\alpha$. The part of the entry heating plates 30 which extends linearly from the exit tangent "$a_2$" up to the rotational axis "e" enables the applied pressure on the material 2 to be pressed to be built up in a short distance, the applied pressure being introduced in a hydraulically controlled manner from about 20 bar at $a_2$ up to the maximum applied pressure which, in this embodiment, is about 50 bar. The build-up of pressure is effected by short stroke cylinder 28 with maximum pressure being reached under short stroke cylinder 28. This compression section can be technologically adapted to the particular requirements. For example, for a medium-pressure veneering application, it can accordingly be longer than for chipboard production in order to bring about a longer airing time over the longer compression distance.

The transfer nose 37 of the feed belt 36 cannot be adjusted with respect to different heights of material to be pressed or different chipboard thicknesses but is arranged in a fixed position in the entry gap 11. A transfer plate 38, pivotable in the axis 39, is inserted in front of the transfer nose 37 so that any adjustment of the lower entry system can be followed. In this arrangement, the position of the transfer nose 37 is advantageously at a greater distance from the two drums at the bottom and top, since the temperature effect of the steel belts 3 and 4 on the plastic belts of the feed belt 36 is thus much reduced, which means increased operational reliability, since the belts are at a low working-temperature level. In addition, this greater distance enables sturdy protective insulation to be attached in order to prevent the effects of heat radiation. The transfer plate 38 can be swung in and out by a parallelogram lever mechanism 44. In other words, during the production change, for example to different chip structures or different board thicknesses, it is useful from the operating point of view to run the feed belt 36 in a reversible manner so that this feed belt 36 then carries the chip mat in the opposite direction to the transport direction into a discharge bunker. At the same time, the rest of the chip mat located on the transfer plate 38 can be moved into a discharge position by swinging away the transfer plate 38 so that the chip mat lying on the plate is automatically discharged onto the conveying belt 36 and can also be transported back into the discharge bunker. In order to prevent sagging over the width of the transfer plate 38, a plurality of vertically adjustable supporting members 41 are provided which rest on a platform 40 of the bottom entry system 18.

According to FIG. 2, within the crossheads 13 and 14, the heating plates 30 may be varied through a compression angle $\alpha$ around the axis of rotation "e" and within the entry gap 11 by means of the hydraulic short stroke cylinder 28. When the compression angle $\alpha$ is changed, the point of the entry tangent 33 at the feeding sprocket 24 or 25 for the roller bars 12 between the radius of curvature $R_E$ in the last third of "c" also changes, as well as the entire precompression area "a" for the material to be pressed and the radius of curvature $R_U$ of the return drum 7 or 8. This angle is represented as angle $\beta$.

Figure 4:
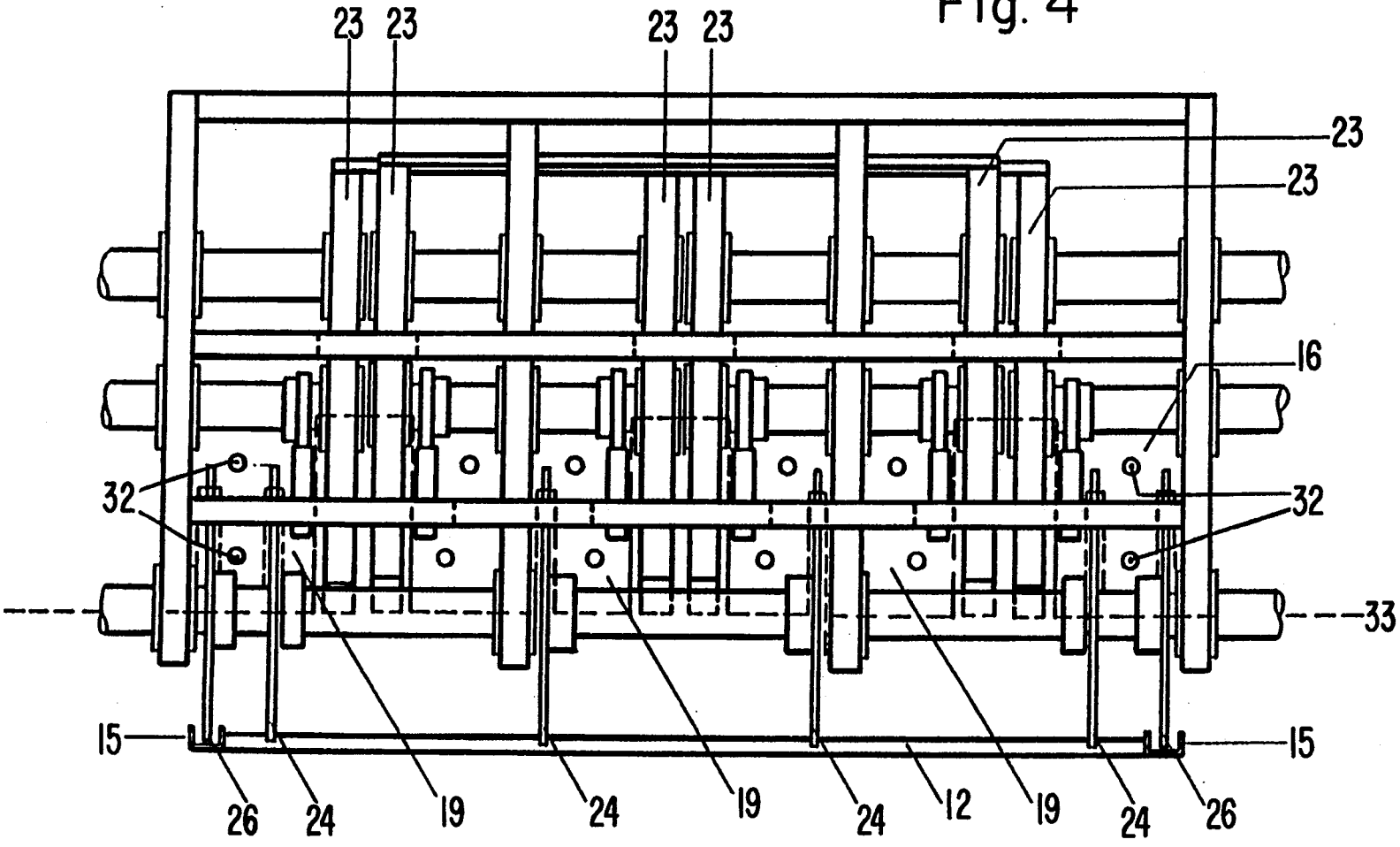
FIG. 4 shows the roller-bar feeding device of the press ram in plan view.

On account of the changing angle $\beta$, it is convenient for the roller-bar orientation section "c" to be of flexible construction so that the roller bars 12 can follow the entry tangent 33 at the steel belt in this area. As FIG. 4 shows, recesses for the feeding sprockets 24 and 25 of the roller bars 12 are provided in the spring plates 19 and pressure-keeping plates 16 and for the stepping mechanisms 23. Recesses are also provided for the entry sprockets 26 and 27 for orientating the roller bars 12 and returning the guide chains 15. These stepping mechanisms 23 are arranged so as to be uniformly distributed over the press width (at least 2 in each case at the top or bottom), so as to provide a functional orthogonal guidance of the roller bars 12 at a distance apart in the feeding area "c". In order to ensure operationally reliable transfer of the material 2 to be pressed, the bottom contact point PK of the material to be pressed is advanced sufficiently far relative to the top contact point PK of the material to be pressed in the opposite direction to the transport direction by a safety distance "X".

Also pertaining to the subject matter of the invention is the fact that the clamping pressure for the roller bars 12 between the steel belts 3 and 4 in the roller-bar orientation area "c", irrespective of the compression of a chip mat, can be specifically built up against the hydraulically pretensioned steel belts 3 and 4, with the following advantage:

After leaving the roller-bar orientation area "c"; the roller bars 12 are constantly clamped fast from "$a_1$" to "$a_2$" with progressively higher pressure, and in fact during the pressure build-up in the area "$a_1$" to "$a_2$" to a level of about 3 bar$=0.4\times HP_{max}$ of the press (e.g., at 50 bar maximum high pressure, the starting pressure in the area "$a_2$" is then 20 bar).

On account of the clamping pressure, increasing up to the contact point PK (a/4) of the material to be pressed at the top steel belt 3, irregularities in the chip mat, e.g. due to spread errors, have no adverse effects on the orthogonal running of the roller bars 12.

The areas "a" and "b" are each rigid, i.e. each is formed by a fixed radius of curvature $R_E=R_U$. Each is straight section connected as one part in an articulated manner in the rotational axis "e". The roller bars 12 are therefore frictionally guided in the areas "a" and "b", after they have been frictionally pressed in the area "c" against the steel belt on account of the leaf-spring effect of spring plate 19. These bars are additionally guided orthogonally at the separating distance in a positive-locking manner by the stepping mechanisms 23. The flexible entry tangent point 33 of the roller bars also has the following advantageous essential feature:

the center of the feeding sprockets 25 and 27 and 24 and 26 is positively connected to follow the movement of tangential position 33, as shown in FIG. 2. Similarly, the bearing of the step-by-step mechanisms 23, which together with the feeding sprockets is located in the inlet system 17 and 18, are positively connected to follow the movement of tangential position 33 while being connected to the feeding sprockets 24 and 25. The inlet systems 17 and 18 are connected positively at the articulation point "f" (FIG. 3) with the pivoting heating plates 30.

The hydraulic support cylinders 32 are mounted in articulation on the stationary crossheads 13 and 14, and act positively on the inlet system 17 and 18. The hydraulic stroke of these support cylinders 32 is determined by the angular position $\alpha$ and the path of the inlet tangent position 33, according to the given angular positions $\beta$ on the upper and lower steel belts 3 and 4. This hydraulic support applies to plates 15 and 19 a clamping force in the rolling rod inlet area which rises from about 1 to 3 bar.

By means of the invention, the optimum compression angle $\alpha$ may be set in keeping with the technical requirements by hydraulic force cylinders, wherein the kinematic layout of these force cylinders relative to the articulation point "e" and the material contact "PK" effects on a steep increase in the force in the frontal compression area, and the spring-hydraulic rolling rod inlet located in front of the curved material compression section operates automatically/independently of the material compression with controlled clamping forces.

By means of the solution according to the invention, a continuously increasing roller-bar contact pressure of the entry tangent 33 can thus be controlled at every compression angle in a servo-hydraulic, positionally-regulated manner in accordance with the requirements of the particular end product to be manufactured.

What is claimed is:

1. A continuously working press for manufacturing pressed materials, said press comprising:

(A) a press ram;

(B) a press table spaced apart from said press ram with an adjustable press gap being formed therebetween;

(C) drive drums and return drums;

(D) first and second flexible, endless steel belts which are guided around said press table and said press ram, respectively, via said drive drums and said return drums, said first and second belts transmitting an applied pressure to a material to be pressed and pulling said material to be pressed though said press;

(E) a plurality of roller bars which are supported on said press table and said press ram and which guide said first and second belts through said press;

(F) a transfer plate which transfers said material to be pressed into said press from a transfer area;

(G) a feed belt which is located in said transfer area and which has a transfer nose, said transfer nose delivering said material to be pressed onto said transfer plate;

(H) first and second heating plates which are pivotally mounted on said press table and said press ram, respectively;

(I) first and second entry devices provided on said first and second heating plates, respectively, and facing each other to form an entry gap therebetween adjacent said press gap, one of said first and second entry devices including a spring plate which exerts an elastic clamping pressure on said roller bars; and (J) an elastic pressure-keeping plate which covers said one entry device and one of said heating plates, said pressure-keeping plate being located between said spring plate and said roller bars;

wherein said spring plate exerts an elastic clamping pressure from 0 to 3 bars as said roller bars travel through said entry gap.

2. The continuously working press as claimed in claim 1, wherein one of said heating plates includes a portion which has been bevelled to produce a free-vibrating wedge which cooperates with said spring plate.

* * * * *